United States Patent [19]

Bauer

[11] 4,239,321

[45] Dec. 16, 1980

[54] CONTACT ELEMENT WITH INTERIOR SUPPORT

[75] Inventor: Erhard Bauer, Rappenau, Fed. Rep. of Germany

[73] Assignee: Bunker Ramo Corporation, Oak Brook, Ill.

[21] Appl. No.: 56,471

[22] Filed: Jul. 11, 1979

[30] Foreign Application Priority Data

Jul. 12, 1978 [DE] Fed. Rep. of Germany ..... 2830620

[51] Int. Cl.[3] ..... H01R 13/04

[52] U.S. Cl. ..... 339/276 T; 339/217 S

[58] Field of Search ..... 339/217 S, 275 T, 276 T

[56] References Cited

U.S. PATENT DOCUMENTS

| | | | |
|---|---|---|---|
| 2,469,397 | 5/1949 | Mezek | 339/217 S |
| 3,009,130 | 11/1961 | Redslob et al. | 339/217 S |
| 3,059,216 | 10/1962 | Cunningham | 339/217 S |
| 3,465,279 | 9/1969 | Krehbiel | 339/217 S |
| 3,998,518 | 12/1976 | Mathe | 339/217 S |

FOREIGN PATENT DOCUMENTS

| | | | |
|---|---|---|---|
| 1254215 | 11/1967 | Fed. Rep. of Germany | 339/275 T |

*Primary Examiner*—John McQuade

*Attorney, Agent, or Firm*—F. M. Arbuckle; B. W. Sufrin

[57] ABSTRACT

The invention relates to a sheet metal contact element which can be inserted into a chamber of an insulating housing and comprises a rear terminal portion for connecting a conductor, a forward contacting portion, and an intermediate locking section with at least one stamped, outwardly protruding locking tab to anchor the contact element in the chamber. When a strong tensile load is applied to prior art contact elements, the locking tabs, which usually are bent slightly outwardly, are deflected toward the interior of the contact element and permanently distorted. Thus, the contact element is no longer kept in the proper axial position, and the damaged contact element must be replaced. This problem is solved by the present invention by providing a reinforcing pin inserted into the inner cavity of the locking portion. The reinforcing pin prevents the locking hook from being deflected into the interior of the contact element when a load is applied. Thus, the reinforcing pin is a radial, inner stop or a radial lock for the locking tab.

6 Claims, 3 Drawing Figures

CONTACT ELEMENT WITH INTERIOR SUPPORT

TECHNICAL FIELD

The invention relates to a sheet metal contact element which can be inserted into a chamber of an insulating housing and comprises a rear terminal portion for connecting a conductor, a forward contacting portion, and an intermediate locking section with at least one stamped, outwardly protruding locking tab to anchor the contact element in a predetermined position within the chamber.

BACKGROUND OF THE PRIOR ART

A known contact element of this type is stamped from a sheet metal strip and rolled to form a substantially cylindrical contact element. One end of the contact element is provided with a terminal portion having tabs for establishing electrical contact with the conductors of a wire by deforming the tab around the end of a conductor. At its other end, the contact member is provided with a contact portion in the form of a tubular pin. The locking portion of the contact element is provided with two stamped, tongue-shaped locking fingers which extend outwardly under an acute angle relative to the longitudinal axis of the contact element. After the conductor has been connected to the terminal portion of the contact element, the forward contacting portion is first pushed into the chamber of an insulating housing. The locking fingers are urged radially inwardly at a constricted passage point inside the chamber. Once the locking fingers have passed beyond the constricted region, they snap radially outwardly and prevent the contact element from being inadvertently removed. In this position the locking fingers absorb the entire pulling force which is exerted upon the contact element via the conductor. In the case of a strong tensile load, the locking fingers, which usually are bent slightly outwardly, are deflected toward the interior of the contact element and permanently distorted. Thus, the contact element is no longer kept in the proper axial position, and the damaged contact element must be replaced. In the case of very small contact elements with contact pins having a size of, say, 1.6 mm, the thickness of the sheet metal can amount to about 0.3 mm only. Therefore, it is not possible to increase the stability of the locking fingers by using sheet metal of greater thickness.

SUMMARY OF THE INVENTION

The problem to be solved by the instant invention is to create a contact element of the above-specified kind in which a secure retention of the contact element inside the contact chamber is guaranteed even when high loads are applied to the contact element.

The problem is solved by the invention by providing a reinforcing pin inserted into the inner cavity of the locking portion.

The reinforcing pin prevents the locking finger from being deflected into the interior of the contact element when a load is applied. Thus, the reinforcing pin is a radial, inner stop or a radial lock for the locking finger. The locking finger is prevented from being deflected outwardly by the chamber walls. While the contact element of the invention can be made from very thin sheet metal, the contact element nevertheless is characterized by a firm anchorage inside the chamber of the insulating housing.

In an advantageous modification of the invention, the reinforcing pin is made from a piece of wire. In this case, the reinforcing pin is a solid pin such as a piece of copper wire. Such wire is available in many standard gauges, and, apart from the cutting, no additional machining is required for producing the reinforcing pins.

BRIEF DESCRIPTION OF THE DRAWINGS

The following is a description of an exemplary embodiment of the invention with reference to the accompanying drawings. In the drawings.

DETAILED DESCRIPTION OF THE INVENTION

Figure 1:
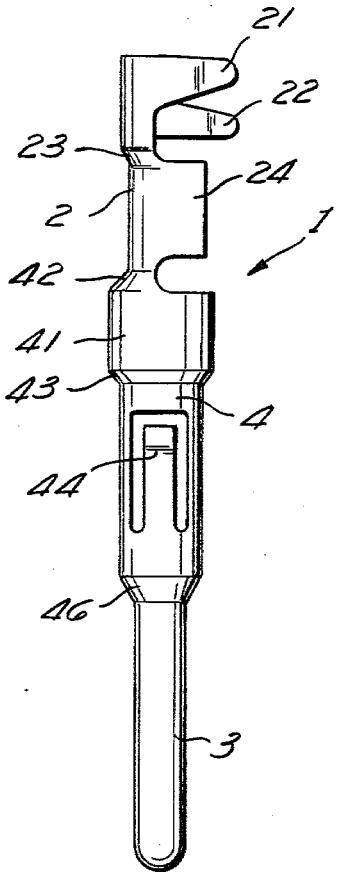
FIG. 1 is a side view of a contact element having the shape of a contact pin.
Figure 2:
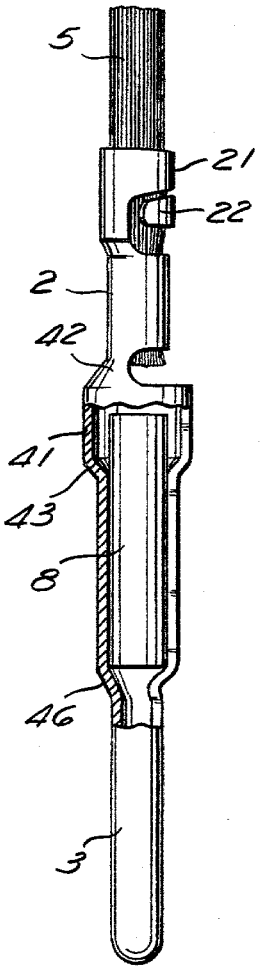
FIG. 2 is a partial cutaway side view of a contact pin connected to a conductor showing the locking portion.
Figure 3:
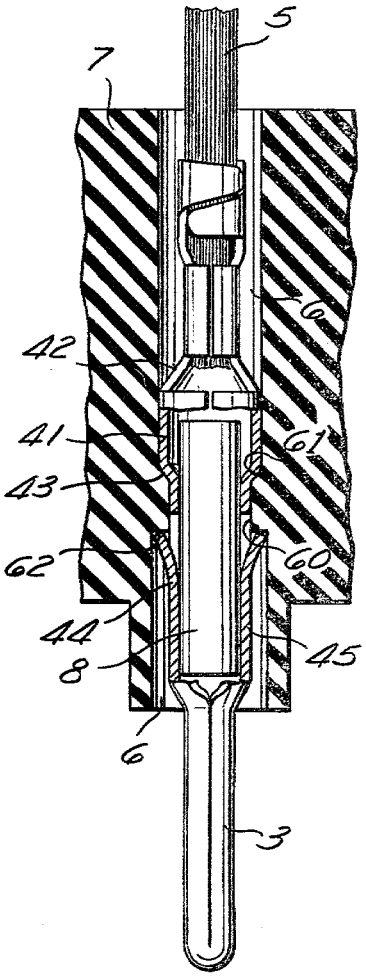
FIG. 3 is a cross-sectional view of a portion of an insulating housing in which a contact pin according to FIG. 1 is inserted into a chamber.

The contact pin, which is generally denoted by 1 in FIG. 1, comprises a terminal portion 2 for connection to a conductor, a contact portion 3 having the shape of a contact pin, and a locking portion 4. The conductor-connecting terminal portion is provided with two claws 21, 22 which, as shown in FIGS. 2 and 3, embrace the insulating material of a wire 5. The portion carrying claws 21, 22 is followed by a shoulder 23 terminating in a portion of reduced diameter with two conductor claws 24. As shown in FIGS. 2 and 3, the conductor at the end of the wire 5 from which the insulation has been removed is squeezed between conductor claws 24.

As shown in FIG. 3, pin 3 of a contact member 1 inserted into the contact chamber 6 of an insulating housing 7 protrudes from the contact chamber. Several such chambers 6 may be provided in insulating housing 7 and a similar contact member may be inserted into each of the contact chambers. The entire assembly is used as a connector to establish electrical contact between a wire 5 and another electrical conductor.

Like pin 3, locking portion 4 has a substantially cylindrical cross section. A portion 41 sized to match the internal diameter of contact chamber 6 is provided with a shoulder 42 on the one end and with another shoulder 43 on the other end closer to the contact portion 3. The latter shoulder is followed by a section of reduced diameter. In that section, two tongue-shaped locking tabs 44, 45 were stamped from the material; as shown in FIG. 3, the tabs 44, 45 protrude outwardly and are slightly bent at their ends. The section of reduced diameter with the locking tabs is characterized by a bevelled shoulder 46 terminating in a closed, rolled-in contact pin 3.

The material used for manufacturing contact member 1 is 0.3 mm thick CuZn 37 F 55. A reinforcing pin 8 made of copper wire is provided in locking portion 4. The diameter of reinforcing pin 8 is determined to correspond to the internal diameter of the locking portion in which locking tabs 44, 45 are formed. Pin 8 is retained between shoulders 42 and 46 in locking portion 4.

As shown in FIG. 3, the contact member, which is attached to one end of the conductor, is pushed from above downward into contact chamber 6 until shoulder 43 of locking portion 4 rests on stop 61 of chamber 6. While inserting, locking tabs 44, 45 are urged radially inwardly as they slide along constricted portion 60 of chamber 6. When shoulder 43 rests on stop 61, locking tabs 44, 45 snap radially outwardly so that they snap behind locking shoulder 62 of insulating chamber 6. Thus, contact member 1 is retained in contact chamber 6 by shoulder 43 cooperating with stop 61 and by locking tabs 44, 45 cooperating with locking shoulder 62. When the contact member is subjected to a pulling force only (e.g., when wire 5 of FIG. 3 is pulled upwardly), locking tabs 44, 45 cannot be deflected into the interior of center portion 4 because of pin 8. The outward movement of the tabs is limited by chamber 6 proper. The locking tabs therefore are urged toward reinforcing pin 8 and absorb the forces substantially in the longitudinal direction.

In order to remove contact member 1 from contact chamber 6, a releasing tool is pushed between the locking tabs and the walls of chamber 6 to urge the locking tabs radially inwardly. When compressed, the points of the locking tabs no longer extend behind the locking shoulder 62 so that the contact member can be pulled upwardly from the contact chamber.

The invention is not restricted to the embodiment shown. Reinforcing pin 8 can be employed in the case of jacks, also. Further, contact pin 8 need not be a solid pin but may be a tubular pin.

From the foregoing, it can be readily realized that this invention can assume various embodiments. Thus, it is to be understood that the invention is not limited to the specific embodiments described herein, but is to be limited only by the appended claims.

I claim:

1. A contact element for insertion into an insulating housing, said contact element comprising: an elongate formed sheet metal body having a terminal end for connection to a wire, a contact end and a locking portion intermediate said two ends, said locking portion including at least one outwardly projecting resilient tab for engaging the housing to anchor the contact element therein; and a stiffening pin in the interior of said locking portion forming an inward stop for limiting inward deflection of said at least one tab.

2. The contact element as claimed in claim 1, wherein said stiffening pin is a piece of wire.

3. The contact element as claimed in claim 1, wherein said stiffening pin is tubular.

4. The contact element as claimed in claim 1, wherein said body is generally tubular.

5. The contact element as claimed in claim 4, wherein said locking portion has an interior diameter corresponding to the exterior diameter of said pin.

6. The contact element as claimed in claim 5, wherein said body includes areas of reduced internal diameter adjacent the ends of said pin to prevent movement of said pin.

* * * * *